US009986878B2

(12) United States Patent
Stelter et al.

(10) Patent No.: US 9,986,878 B2
(45) Date of Patent: Jun. 5, 2018

(54) TOILET SEAT HINGE

(71) Applicant: Bemis Manufacturing Company, Sheboygan Falls, WI (US)

(72) Inventors: Michael Stelter, Sheboygan, WI (US); Brian Le Mahieu, Sheboygan, WI (US); John Seaman, Sheboygan Falls, WI (US)

(73) Assignee: Bemis Manufacturing Company, Sheboygan Falls, WI (US)

( * ) Notice: Subject to any disclaimer, the term of this patent is extended or adjusted under 35 U.S.C. 154(b) by 1282 days.

(21) Appl. No.: 13/621,586

(22) Filed: Sep. 17, 2012

(65) Prior Publication Data

US 2013/0067647 A1 Mar. 21, 2013

Related U.S. Application Data

(60) Provisional application No. 61/535,068, filed on Sep. 15, 2011.

(51) Int. Cl.

| | |
|---|---|
| ***A47K 13/12*** | (2006.01) |
| ***A47K 13/26*** | (2006.01) |
| *E04C 3/34* | (2006.01) |

(52) U.S. Cl.

CPC ..... *A47K 13/12* (2013.01); *A47K 13/26* (2013.01); *E04C 3/34* (2013.01)

(58) Field of Classification Search

USPC ..... 4/236–240; D8/323–326

See application file for complete search history.

(56) References Cited

U.S. PATENT DOCUMENTS

| | | | | |
|---|---|---|---|---|
| 4,314,382 | A | 2/1982 | Ginsburg et al. | |
| 4,326,307 | A | 4/1982 | Baillie et al. | |
| 5,175,891 | A | 1/1993 | Ohshima et al. | |
| D370,252 | S * | 5/1996 | Hulsebus | D8/326 |
| 6,070,295 | A | 6/2000 | Hulsebus | |
| 6,826,803 | B2 * | 12/2004 | Twomey | 16/387 |
| 7,281,276 | B2 | 10/2007 | Vierkant, III et al. | |
| 7,827,626 | B2 | 11/2010 | Zhou | |

(Continued)

FOREIGN PATENT DOCUMENTS

| | | |
|---|---|---|
| CN | 201905813 | 7/2011 |
| EP | 1800585 | 6/2007 |

OTHER PUBLICATIONS

PCT/US2012/055763 International Search Report and Written Opinion dated Oct. 15, 2013 (10 pages).

(Continued)

*Primary Examiner* — Erin Deery

(74) *Attorney, Agent, or Firm* — Michael Best & Friedrich LLP

(57) ABSTRACT

A toilet seat hinge for mounting a toilet seat to a toilet bowl includes a hinge post and a pin extending through the hinge post and defining an axis. The pin is configured to attach the toilet seat to the hinge post for pivotal movement about the axis. The toilet seat hinge also includes a quick release mechanism for releasably securing the hinge post to the toilet bowl. The quick release mechanism includes a member coupled to the pin for pivotal movement about the axis. The member is pivotable about the axis between a first position in which the hinge post is secured to the toilet bowl, and a second position in which the hinge post is released from the toilet bowl.

21 Claims, 9 Drawing Sheets

(56) References Cited

U.S. PATENT DOCUMENTS

| | | | | |
|---|---|---|---|---|
| 8,763,168 | B2 * | 7/2014 | Zhou | 4/236 |
| 2009/0000017 | A1 | 1/2009 | Zhou | |
| 2009/0113610 | A1 | 5/2009 | Lin et al. | |

OTHER PUBLICATIONS

International Preliminary Report on Patentability for International Application No. PCT/US12/55763 dated Apr. 30, 2014 (9 pages).
First Office Action from the State Intellectual Property Office of China for Application No. 201280045206.5 dated Dec. 2, 2015.

* cited by examiner

TOILET SEAT HINGE

CROSS-REFERENCE TO RELATED APPLICATIONS

This application claims priority to U.S. Provisional Patent Application No. 61/535,068, filed Sep. 15, 2011, the entire contents of which are incorporated by reference herein.

BACKGROUND

The present invention relates to toilet seat hinges.

A toilet seat and cover are typically pivotally coupled to a toilet bowl by hinges. The hinges allow the toilet seat and cover to pivot relative to the toilet bowl between a raised position and a lowered position. It is sometimes desirable to remove the toilet seat, the cover, and the hinges from the toilet bowl in order to properly clean the toilet; however, the hinges are typically secured to the bowl with bolts, making it difficult to remove the hinges without tools. Various types of quick-release hinges to facilitate removal of the seat and cover are known.

SUMMARY

In one embodiment, the invention provides a toilet seat hinge for mounting a toilet seat to a toilet bowl. The toilet seat hinge includes a hinge post and a pin extending through the hinge post and defining an axis. The pin is configured to attach the toilet seat to the hinge post for pivotal movement about the axis. The toilet seat hinge also includes a quick release mechanism for releasably securing the hinge post to the toilet bowl. The quick release mechanism includes a member coupled to the pin for pivotal movement about the axis. The member is pivotable about the axis between a first position in which the hinge post is secured to the toilet bowl, and a second position in which the hinge post is released from the toilet bowl.

In another embodiment, the invention provides a toilet seat hinge for mounting a toilet seat to a toilet bowl. The toilet seat hinge includes a hinge post and a pin extending through the hinge post and defining an axis. The pin is configured to attach the toilet seat to the hinge post for pivotal movement about the axis. The toilet seat hinge also includes a quick release mechanism for releasably securing the hinge post to the toilet bowl. The quick release mechanism includes a mounting post configured to extend from the toilet bowl and a finger coupled to the hinge post. The finger is engageable with the mounting post to secure the hinge post to the toilet bowl. The quick release mechanism also includes a cap member having a ring and a wall. The ring surrounds a portion of the pin to couple the cap member to the hinge post for pivotal movement about the axis. The cap member is pivotable about the axis between a first position in which the wall engages the finger to secure the hinge post to the toilet bowl, and a second position in which the wall disengages the finger such that the hinge post is released from the toilet bowl.

In yet another embodiment, the invention provides a toilet seat assembly including a toilet seat and a hinge for mounting the toilet seat to a toilet bowl. The hinge includes a hinge post and a pin extending through the hinge post and defining an axis. The pin is configured to attach the toilet seat to the hinge post for pivotal movement about the axis. The hinge also includes a quick release mechanism for releasably securing the hinge post to the toilet bowl. The quick release mechanism includes a member coupled to the pin for pivotal movement about the axis. The member is pivotable about the axis between a first position in which the hinge post is secured to the toilet bowl, and a second position in which the hinge post is released from the toilet bowl.

Other aspects of the invention will become apparent by consideration of the detailed description and accompanying drawings.

DETAILED DESCRIPTION

Before any embodiments of the invention are explained in detail, it is to be understood that the invention is not limited in its application to the details of construction and the arrangement of components set forth in the following description or illustrated in the following drawings. The invention is capable of other embodiments and of being practiced or of being carried out in various ways.

Figure 1:
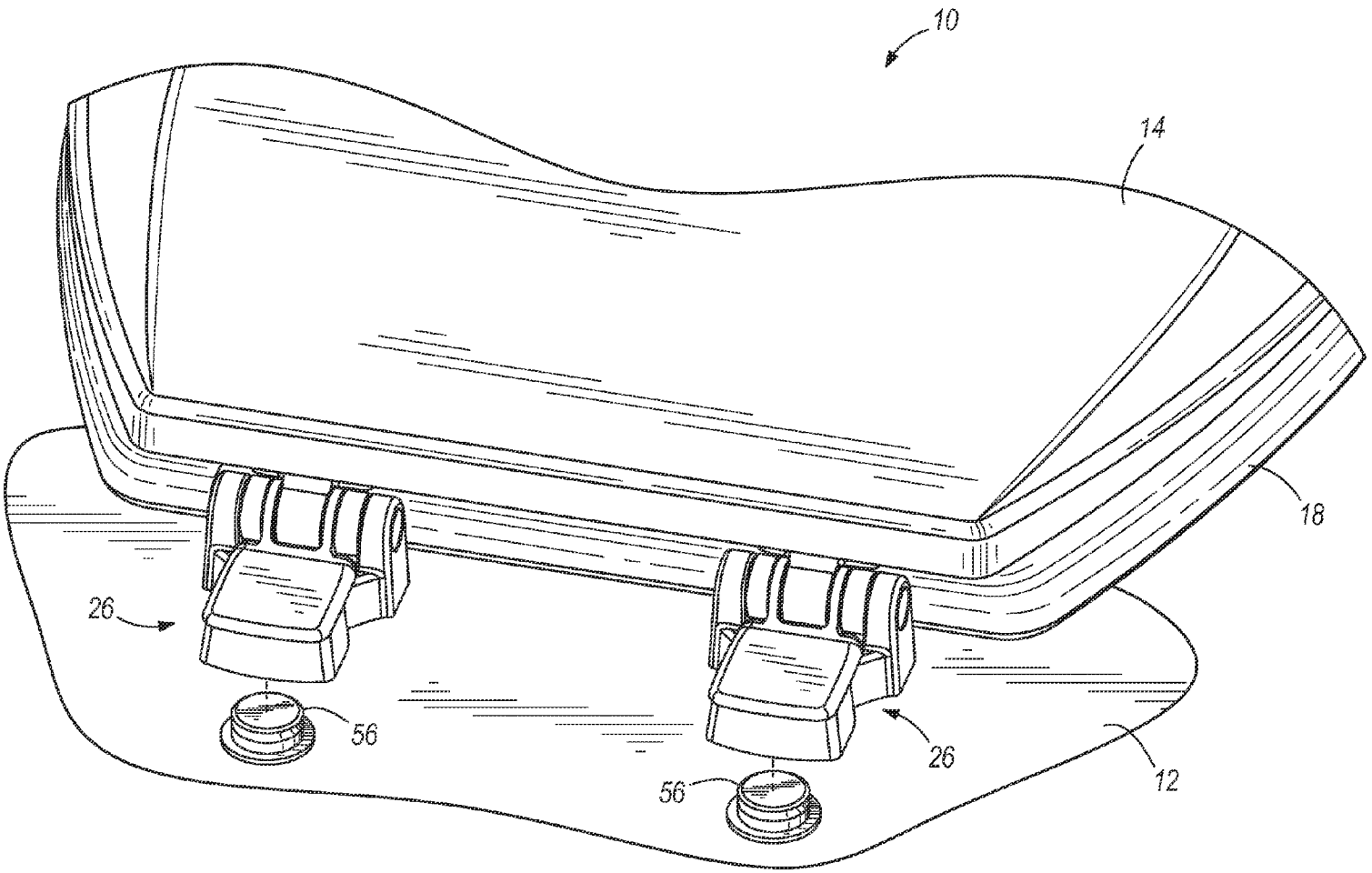
FIG. 1 is a perspective view of a portion of a toilet seat assembly including a toilet seat hinge embodying the invention.
Figure 2:
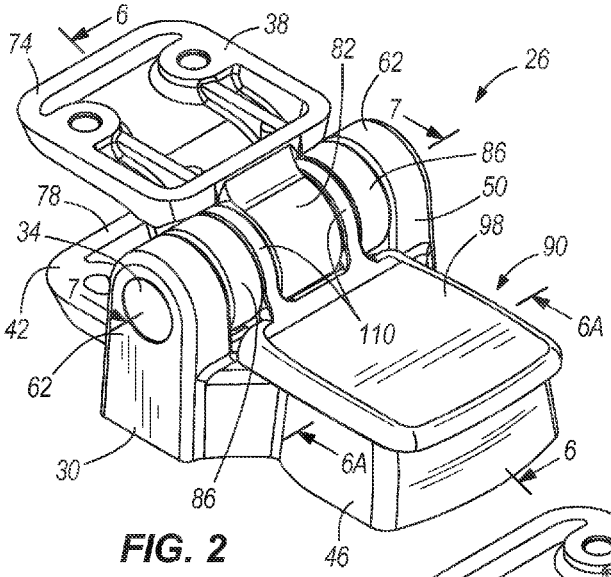
FIG. 2 is a top perspective view of the toilet seat hinge shown in FIG. 1, the toilet seat hinge including a cap member in a closed position.

FIG. 1 illustrates a toilet seat assembly 10 that is mountable to a toilet bowl 12. The toilet seat assembly 10 includes a toilet cover or lid 14, a toilet seat 18, and two toilet seat hinges 26. The hinges 26 pivotally couple the cover 14 and the seat 18 to the toilet bowl 12. Each of the hinges 26 may be formed of, for example, injection molded plastic. Although only one of the hinges 26 is described in detail below, it should be readily apparent that the two hinges 26 are generally the same and interchangeable. In some constructions, the hinges 26 may be mirror images of each other such that one hinge is suitable for mounting on the left side of the toilet bowl 12, while the other hinge is suitable for mounting on the right side of the toilet bowl 12.

As shown in FIGS. 2-7, the toilet seat hinge 26 includes a hinge post 30, a pin 34 extending through a portion of the hinge post 30, and two hinge leaves 38, 42 coupled to the pin 34. The hinge post 30 includes a base portion 46 and a post portion 50. In the illustrated construction, the base portion 46 and the post portion 50 are integrally formed as a single piece. In other constructions, the base portion 46 and the post portion 50 may be separate pieces that are connected together. The base portion 46 is configured to sit on the toilet bowl 12 and defines an opening 54. The opening 54 receives a mounting member or post 56 (FIG. 1) that extends upwardly from the bowl 12. In some constructions, the mounting member 56 may include a threaded bolt that extends through the toilet bowl 12 and a nut that secures the threaded bolt to the bowl 12 (similar to mounting post 204 in U.S. Pat. No. 6,070,295, the entire contents of which are incorporated by reference herein). In other constructions, the mounting member 56 may be separate from the bolt (similar to the retention bases shown in U.S. Pat. No. 7,827,626). The mounting member 56 is insertable into the opening 54 of the base portion 46 along a central axis 58 defined by the opening 54. The post portion 50 includes two legs 62 that extend generally perpendicularly from the base portion 46. The illustrated legs 62 are spaced apart from one another and define bores 66 (FIG. 7) for receiving the pin 34.

Figure 6:
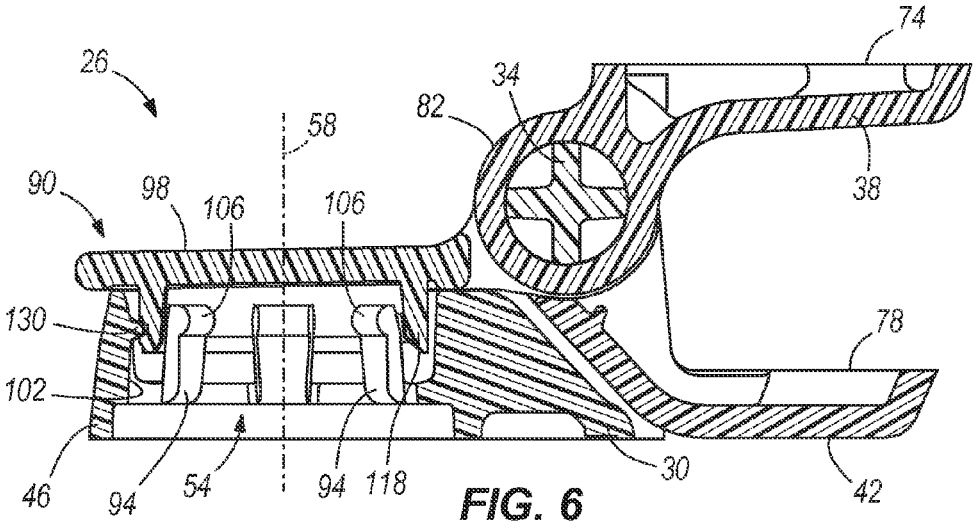
FIG. 6 is a cross-sectional view of the toilet seat hinge taken along section line 6-6 of FIG. 2.
Figure 7:
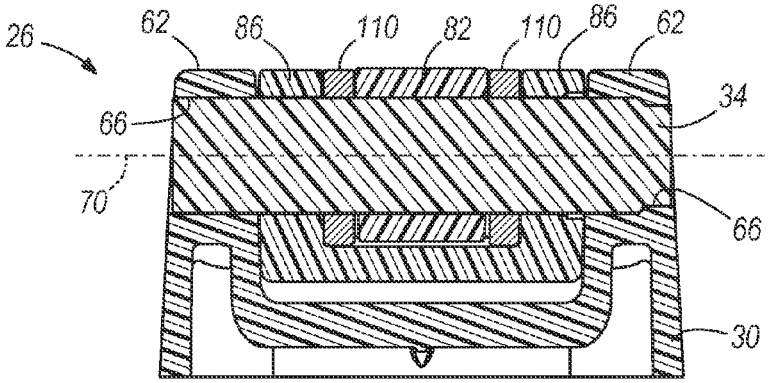
FIG. 7 is a cross-sectional view of the toilet seat hinge taken along section line 7-7 of FIG. 2.

The pin 34 spans the legs 62 of the post portion 50 and extends through the bores 66. The pin 34 defines a longitudinal axis 70 that is the pivot axis of the hinge leaves 38, 42. The illustrated longitudinal axis 70 is generally perpendicular to the central axis 58. In the illustrated construction, the pin 34 has a generally X- or cross-shaped cross-section (FIG. 6). In other constructions, the pin 34 may have a generally circular cross-section.

The first hinge leaf 38 includes a first mounting portion 74 and a first hinge portion 82, and the second hinge leaf 42 includes a second mounting portion 78 and a second hinge portion 86. The first mounting portion 74 connects to the toilet cover 14 (FIG. 1). The second mounting portion 78 connects to the toilet seat 18 (FIG. 1). The first hinge portion 82 is formed as a relatively wide ring. The second hinge portion 86 is formed as two narrower, spaced apart rings that are positioned on opposing sides of the first hinge portion 82, but are partially connected together along an arc to form a U-shape (see FIG. 7). The hinge portions 82, 86 are positioned between the legs 62 of the post portion 50 and align with the bores 66 to receive the pin 34. The pin 34 pivotally couples the hinge leaves 38, 42 to the hinge post 30 such that the hinge leaves 38, 42 are pivotable about the longitudinal axis 70 to raise and lower the cover 14 and the seat 18 relative to the toilet bowl 12.

Figure 6A:
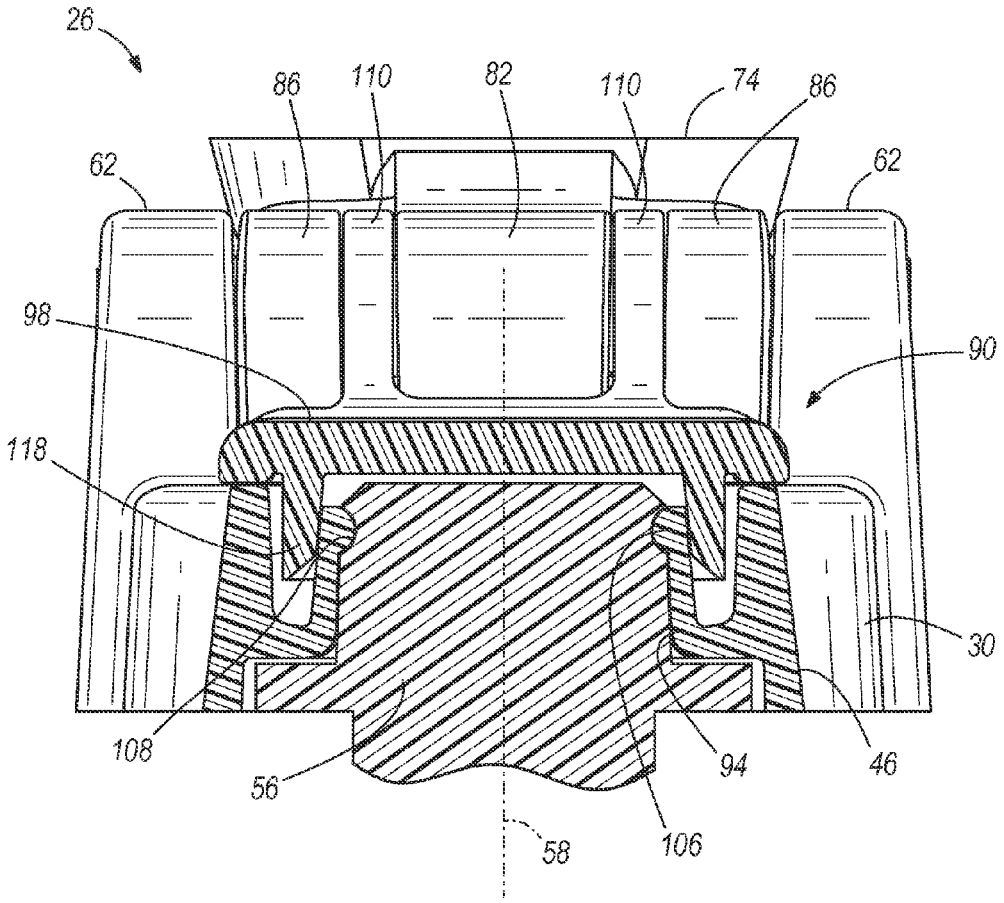
FIG. 6A is a cross-sectional view of the toilet seat hinge taken along section line 6A-6A of FIG. 2 with the toilet seat hinge engaging a mounting member.
Figure 8:
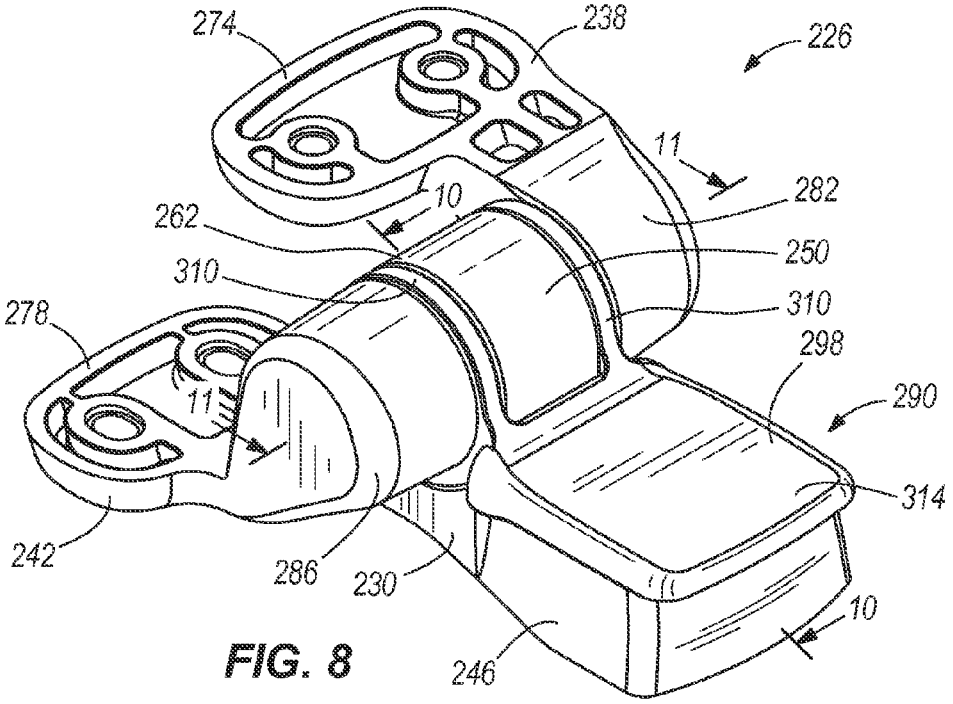
FIG. 8 is a top perspective view of another toilet seat hinge, the toilet seat hinge including a cap member in a closed position.

The toilet seat hinge 26 also includes a quick release mechanism 90 for releasably securing the hinge post 30 to the toilet bowl 12. The illustrated quick release mechanism 90 includes the mounting member or post 56, movable fingers 94, and a cap member 98. The mounting member 56 and the movable fingers 94 are similar to a construction shown in U.S. Pat. No. 6,070,295. The movable fingers 94 are positioned adjacent the opening 54 in the hinge post 30 to selectively engage the mounting member 56 (FIG. 6A). In the illustrated construction, the quick release mechanism 90 includes six movable fingers 94 that are circumferentially spaced around the opening 54. In other constructions, the quick release mechanism 90 may include fewer or more movable fingers 94. The fingers 94 define a gap 102 between an inner surface of the base portion 46 and outer surfaces of the fingers 94. The illustrated fingers 94 are integrally formed with the base portion 46 and extend generally parallel to the central axis 58 defined by the opening 54. In other constructions, the fingers 94 may be separate members that are coupled to the base portion 46. Each finger 94 includes an enlarged distal end 106 opposite the base portion 46. As shown in FIG. 6A, the enlarged distal ends 106 engage (e.g., fit within) a corresponding circumferential groove or recess 108 in the mounting member 56 to secure the hinge post 30 to the mounting member 56.

Figure 5:
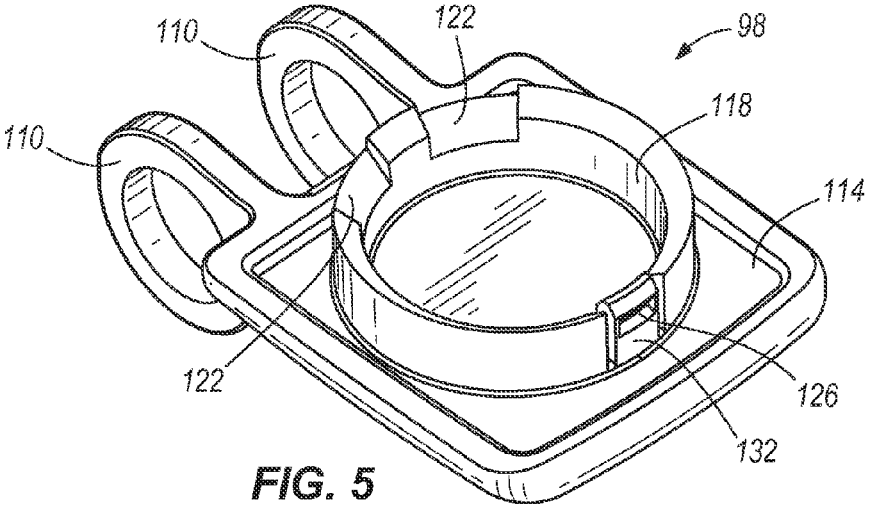
FIG. 5 is a bottom perspective view of a cap member of the toilet seat hinge shown in FIG. 1.

The cap member 98 is operable to move the fingers 94 into engagement with the mounting member 56. The member 98 is coupled to the hinge post 30 by the pin 34 for pivotal movement about the longitudinal axis 70. As shown in FIG. 5, the member 98 includes two rings 110, a cap 114, and an annular wall 118. The rings 110 are configured to receive the pin 34 to pivotally couple the member 98 to the hinge post 30. In some constructions, such as the illustrated construction, the rings 110 can rotate around the pin 34 such that member 98 pivots relative to the pin 34. In other constructions, the member 98 can pivot with the pin 34 relative to the hinge post 30. The illustrated rings 110 are spaced apart to fit on either side of the first hinge portion 82 of the first hinge leaf 38, but within the second hinge portion 86 of the second hinge leaf 42. The rings 110 are also positioned between the legs 62 of the post portion 50. The cap 114 extends from the rings 110 and supports the wall 118. The wall 118 extends outwardly from the cap 114 generally toward the base portion 46 of the hinge post 30. The wall 118 is shaped and sized to fit within the gap 102 between the movable fingers 94 and the base portion 46 to engage and move the fingers 94.

Figure 3:
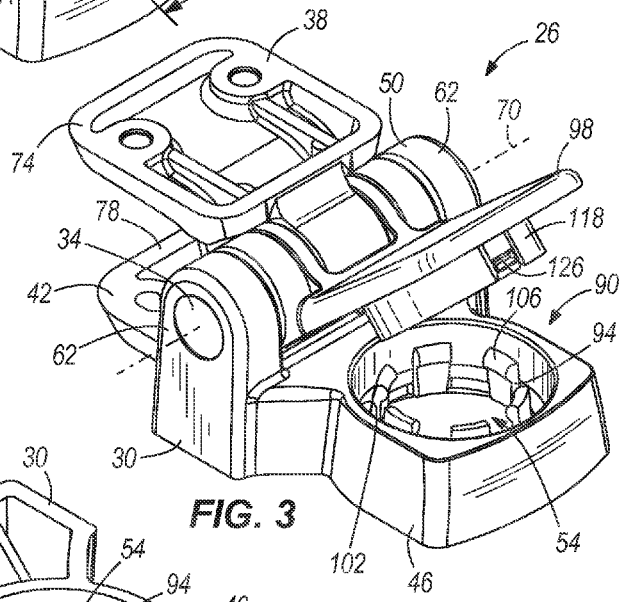
FIG. 3 is a top perspective view of the toilet seat hinge shown in FIG. 1, the toilet seat hinge including the cap member in an open position.
Figure 4:
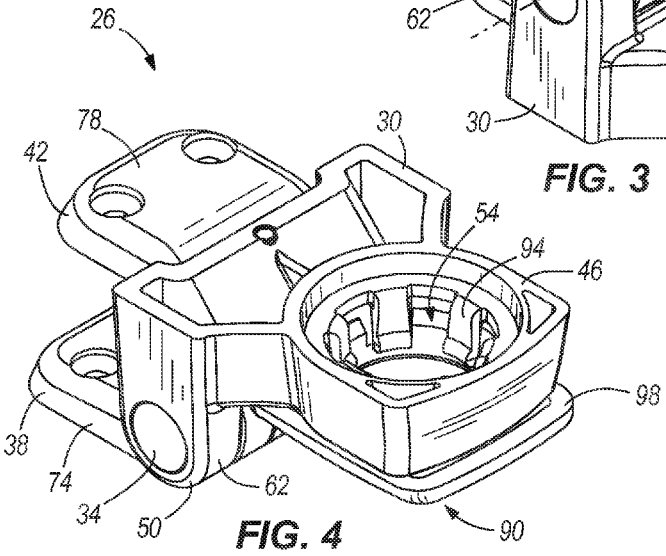
FIG. 4 is a bottom perspective view of the toilet seat hinge shown in FIG. 1.

The member 98 is movable (e.g., pivotable) relative to the hinge post 30 between a first, or closed, position (FIG. 2) and a second, or open, position (FIG. 3). To move the member 98 to the closed position, the member 98 is pivoted about the longitudinal axis 70 of the pin 34 toward the base portion 46 until the wall 118 extends into the gap 102 between the fingers 94 and the base portion 46. Recesses 122 (FIG. 5) formed on an inner surface of the wall 94 provide clearance for the fingers 94 nearest the post portion 50 as the member 98 pivots toward the closed position. The recesses 122 allow the cap member 98 to pivot to the closed position without having the wall 118 get stuck on the fingers 94.

When in the closed position, the wall 118 engages the fingers 94 to bias the fingers 94 radially inward toward the central axis 58 of the opening 54. In this condition, the enlarged distal ends 106 of the fingers 94 engage the mounting member 56 to secure the hinge post 30 to the mounting member 56 and, thereby, the toilet bowl 12. In addition, the cap 114 of the member 98 substantially covers the opening 54 in the hinge post 30 to block the mounting member 56 and the fingers 94 from view and to protect the quick release mechanism 90 from dirt, dust, and other particles.

As shown in FIGS. 3 and 5, the member 98 includes a recess 126 formed in an outer surface of the wall 118. The recess 126 engages a corresponding detent 130 (FIG. 6) on the base portion 46 to releasably secure the member 98 in the closed position. The recess 126 is formed on a non-continuous (e.g., separate) portion 132 of the wall 118 that may deflect relative to the remainder of the wall 118 to facilitate engagement and disengagement of the recess 126 and the detent 130. In the illustrated construction, the non-continuous portion 132 and the recess 126 are located toward a front of the member 98 opposite the rings 110. In other constructions, the recess 126 may be located elsewhere on the member 98.

Referring to FIG. 3, to move the member 98 to the open position, the member 98 is pivoted about the longitudinal axis 70 of the pin 34 away from the base portion 46. As the member 98 moves away from the base portion 46, the wall 118 moves out of the gap 102 between the fingers 94 and the base portion 46. The member 98 thereby disengages the fingers 94, allowing the fingers 94 to move radially outward away from the central axis 58. In this condition, the fingers 94 disengage the mounting member 56 such that the hinge post 30 is released from the mounting member 56 and the toilet bowl 12.

In other constructions, the movable fingers 94 may be coupled to or integrally formed on the mounting member 56. In such constructions, the wall 118 of the member 98 may be shaped and sized to fit within a perimeter defined by the fingers 94. When the member 98 is moved to the closed position, the wall 118 can bias the fingers 94 radially outward away from the central axis 58 of the opening 54. In this condition, the fingers 94 can engage a portion of the hinge post 30 to secure the hinge post 30 to the mounting member 56 and the toilet bowl 12. When the member 98 is moved to the open position, the wall 118 can disengage the fingers 94, allowing the fingers 94 to move radially inward toward the central axis 58 of the opening 54. In this condition, the fingers 94 can disengage the hinge post 30 to release the hinge post 30 from the mounting member 56 and the toilet bowl 12.

FIGS. 8-11 illustrate another toilet seat hinge 226. The toilet seat hinge 226 is similar to the toilet seat hinge 26 shown in FIGS. 2-7, and like parts have been given the same reference numbers, plus 200. The toilet seat hinge 226 is usable with the toilet seat assembly 10 shown in FIG. 1.

The illustrated toilet seat hinge 226 includes a hinge post 230, a pin 234 extending through a portion of the hinge post 230, and two hinge leaves 238, 242 coupled to the pin 234. The hinge post 230 includes a base portion 246 and a post portion 250. Similar to the base portion 46 discussed above, the illustrated base portion 246 defines an opening 254 that receives a mounting member (e.g., the mounting member 56 shown in FIG. 1). In the illustrated construction, the post portion 250 includes a single leg 262 that extends generally perpendicularly from the base portion 246 and defines a bore 266 for receiving the pin 234.

Figure 10:
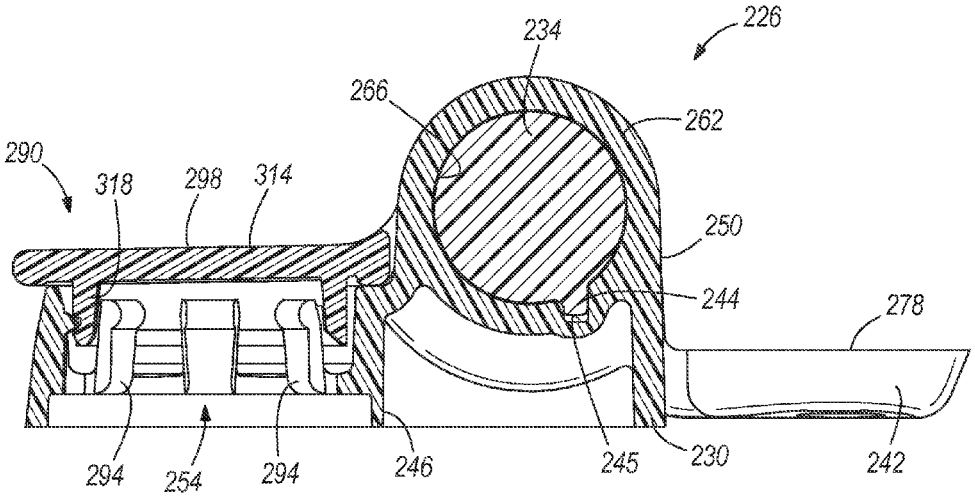
FIG. 10 is a cross-sectional view of the toilet seat hinge taken along section line 10-10 of FIG. 8.
Figure 11:
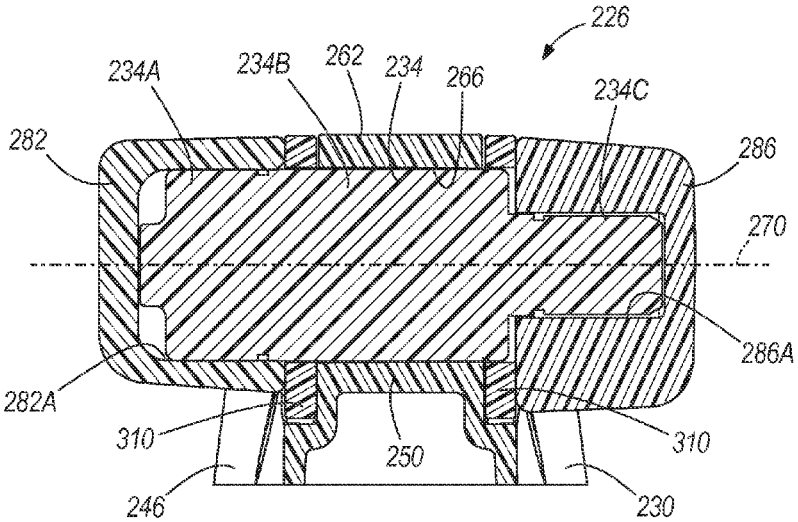
FIG. 11 is a cross-sectional view of the toilet seat hinge taken along section line 11-11 of FIG. 8.

The pin 234 extends through and axially out of both ends of the bore 266 in the post portion 250. In the illustrated construction, the pin 234 has a generally circular cross-section, rather than a cross-shaped cross-section, and defines a longitudinal axis 270. In addition, the illustrated pin 234 has three sections 234A, 234B, 234C of differing diameters to facilitate properly connecting the hinge leaves 238, 242 to the pin 234. As shown in FIG. 10, a projection 244 extends radially from the mid section 234B of the pin 234 and into a groove 245 in the hinge post 230 to inhibit rotation of the pin 234 relative to the hinge post 230.

Similar to the hinge leaves 38, 42 discussed above, each of the hinge leaves 238, 242 shown in FIGS. 8-11 includes a mounting portion 274, 278 and a hinge portion 282, 286, respectively. The hinge portions 282, 286 mount to ends of the pin 234 to pivotally couple the hinge leaves 238, 242 to the hinge post 230. In the illustrated construction, the hinge portions 282, 286 define blind bores (FIG. 11) for receiving the pin 234. The hinge portion 282 of the first hinge leaf 238 has a relatively large diameter blind bore 282A that receives the larger diameter end section 234A of the pin 234. The hinge portion 282 of the second hinge leaf 238 defines a relatively small diameter blind bore 286A that receives the smaller diameter end section 234C of the pin 234. The hinge portions 282, 286 thereby form end caps that enclose the pin 234.

Figure 9:
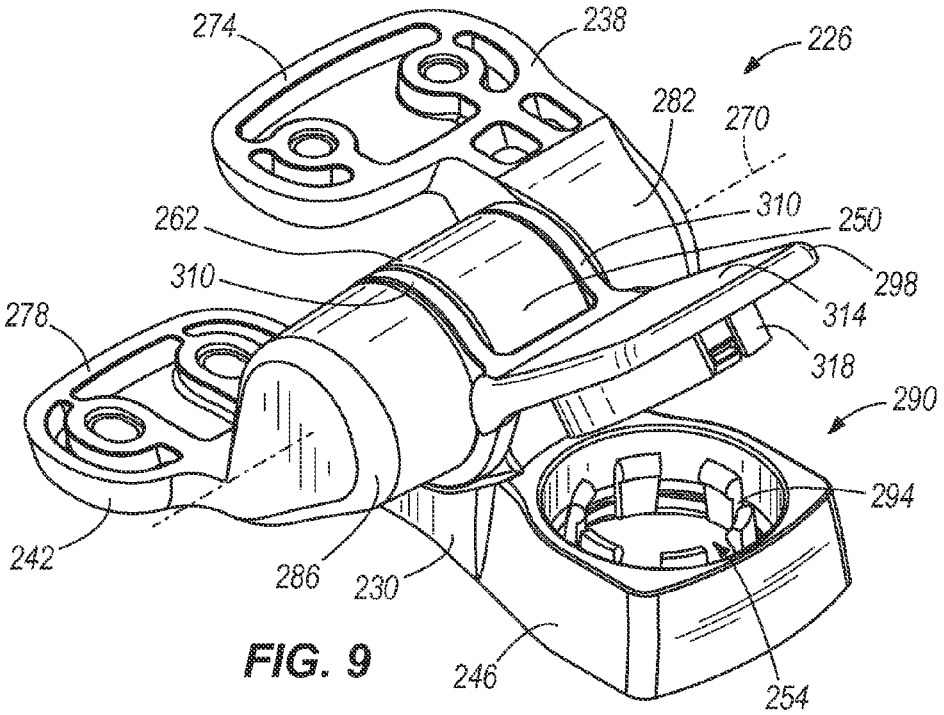
FIG. 9 is a top perspective view of the toilet seat hinge shown in FIG. 8, the toilet seat hinge including the cap member in an open position.

The toilet seat hinge 226 also includes a quick release mechanism 290 for releasably securing the hinge post 230 to a toilet bowl. The quick release mechanism 290 includes the mounting member, movable fingers 294, and a cap member 298. The member 298 includes two rings 310, a cap 314, and an annular wall 318. In the illustrated construction, the rings 310 are spaced apart to fit on opposing sides of the post portion 250 of the hinge post 230 and between the hinge portions 282, 286 of the hinge leaves 238, 242. The rings 310 receive the pin 234 to pivotally couple the member 298 to the hinge post 230 for movement between a closed position (FIG. 8) and an open position (FIG. 9). The illustrated quick release mechanism operates 290 in a similar manner to the quick release mechanism 90 discussed above with reference to FIGS. 2-7 to selectively secure the hinge post 230 to the mounting member and the toilet bowl.

Figure 12:
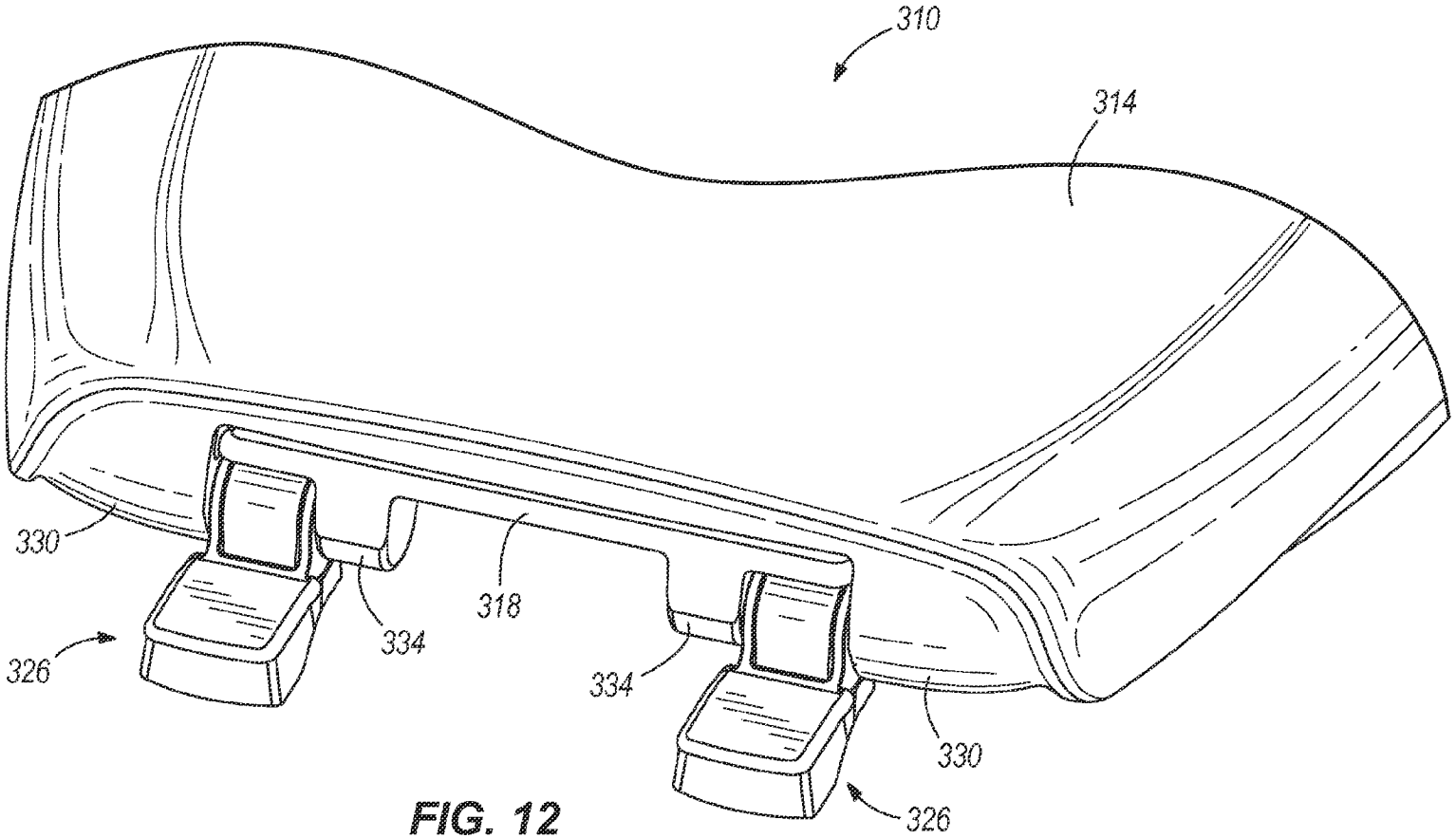
FIG. 12 is a perspective view of a portion of another toilet seat assembly including a toilet seat hinge embodying the invention
Figure 13:
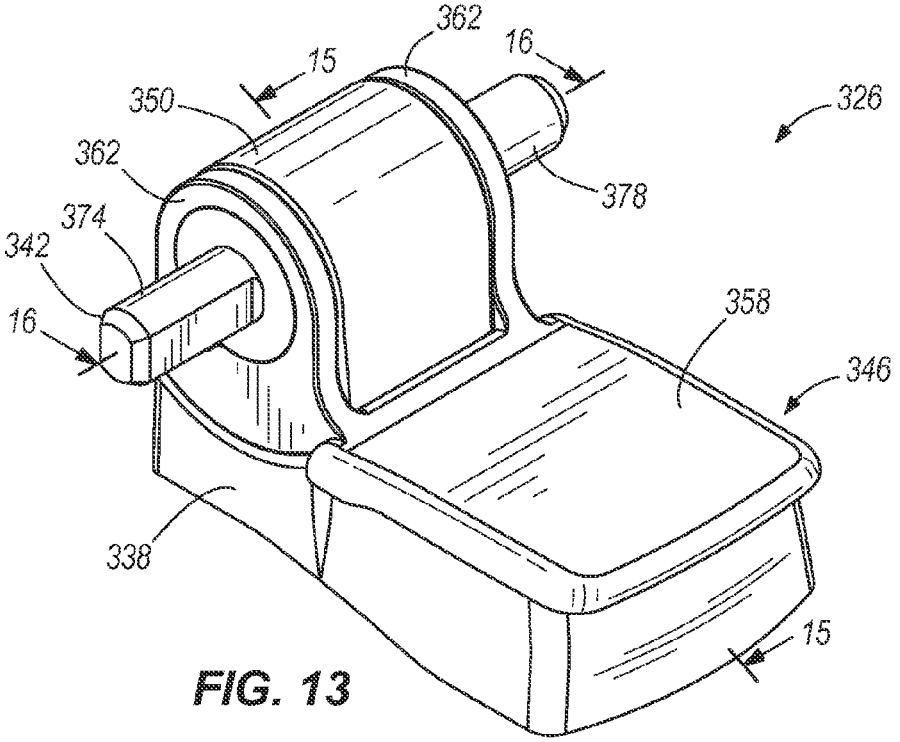
FIG. 13 is a top perspective view of the toilet seat hinge shown in FIG. 12, the toilet seat hinge including a cap member in a closed position.

FIG. 12 illustrates another toilet seat assembly 310 that is mountable to a toilet bowl. Similar to the assembly 10 discussed above, the illustrated toilet seat assembly 310 includes a toilet cover or lid 314, a toilet seat 318, and two toilet seat hinges 326. The hinges 326 pivotally couple the cover 314 and the seat 318 to the toilet bowl. In the illustrated construction, the hinges 326 do not include separate hinge leaves. Instead, the leaves are integrally formed with the cover 314 and the seat 318 as bosses 330, 334 extending from the cover 314 and the seat 318.

As shown in FIGS. 13-16, the toilet seat hinge 326 includes a hinge post 338, a pin 342 extending through a portion of the hinge post 338, and a quick release mechanism 346 for releasably securing the hinge post 338 to the toilet bowl. The hinge post 338, the pin 342, and the quick release mechanism 346 are similar to the corresponding parts discussed above with reference to FIGS. 2-11, and only differences between the designs are described below.

The illustrated hinge post 338 includes a post portion 350 composed as a single leg. The pin 342 extends through and outwardly from both sides of the post portion 350. With such an arrangement, the toilet cover 314 and the toilet seat 318 (FIG. 12) directly couple to the pin 342 for pivotal movement about an axis 354, rather than indirectly couple to the pin 342 via separate hinge leaves.

Figure 14:
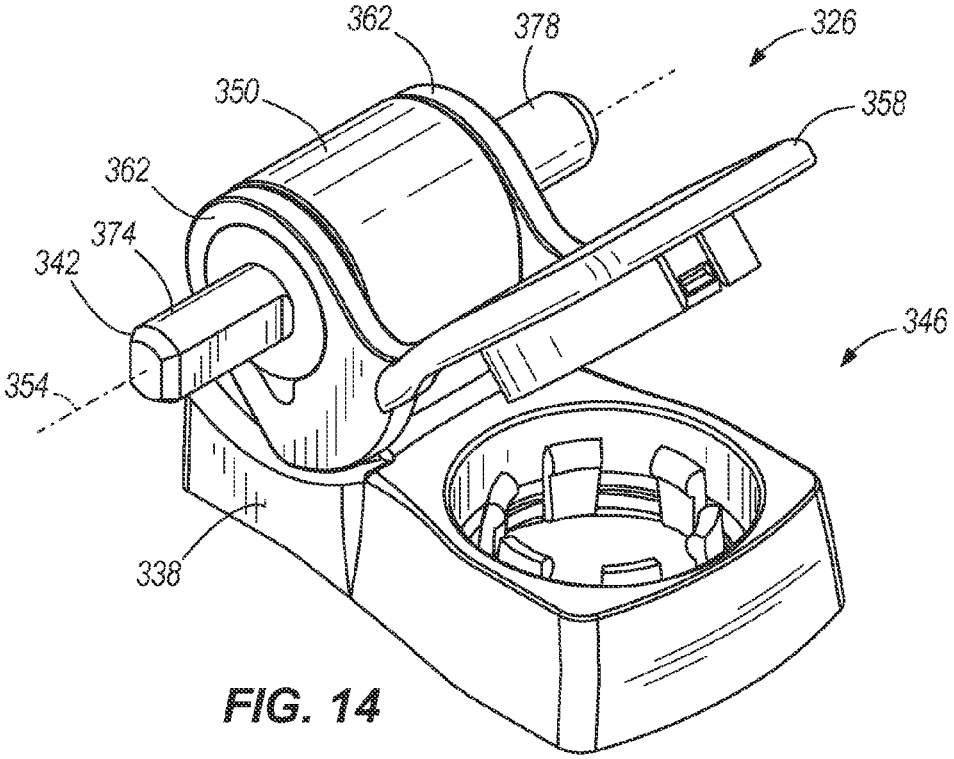
FIG. 14 is a top perspective view of the toilet seat hinge shown in FIG. 12, the toilet seat hinge including the cap member in an open position.
Figure 15:
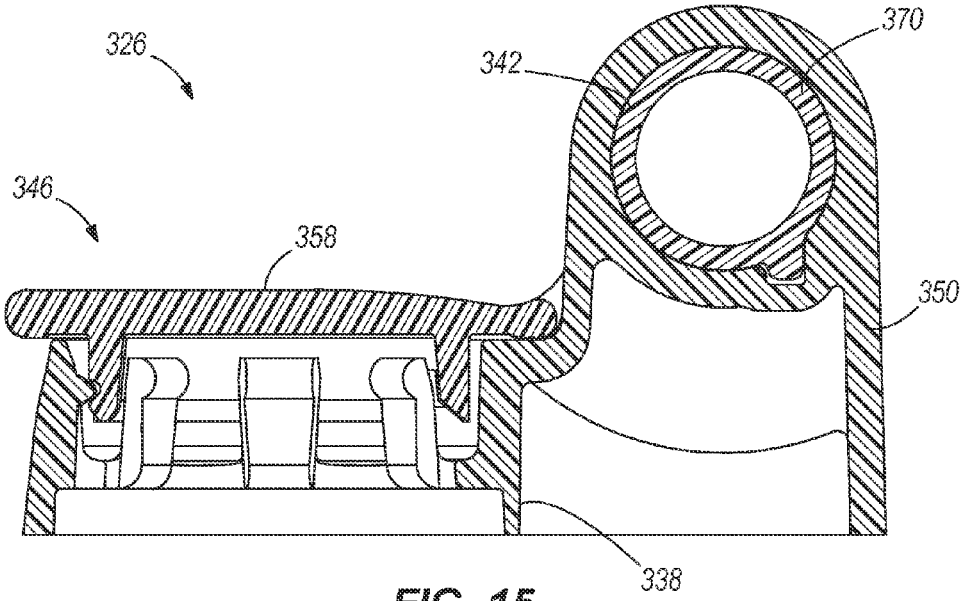
FIG. 15 is a cross-sectional view of the toilet seat hinge taken along section line 15-15 of FIG. 13.
Figure 16:
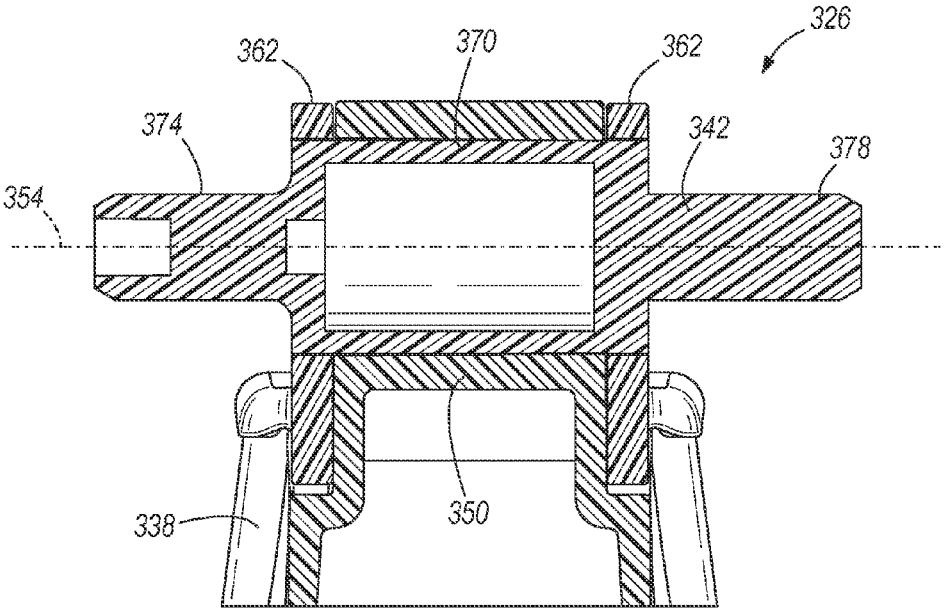
FIG. 16 is a cross-sectional view of the toilet seat hinge taken along section line 16-16 of FIG. 13.

Furthermore, the quick release mechanism 346 includes a cap member 358 having two rings 362. The rings 362 are positioned on opposing sides of the post portion 350 and surround the pin 342 such that the cap member 358 can pivot about the axis 354 between a closed position (FIG. 13) and an open position (FIG. 14). A portion 370 of the pin 342 positioned within the post portion 350 and surrounded by the rings 362 generally has a larger diameter than portions 374, 378 of the pin 342 that extend into the bosses 330, 334 in the toilet cover 314 and the toilet seat 318.

Although the invention has been described with reference to specific types of quick release mechanisms, other types of quick release mechanisms that can be actuated by a member pivotally coupled to a hinge post are within the scope of the invention. Various features and advantages of the invention are set forth in the following claims.

What is claimed is:

1. A toilet seat hinge for mounting a toilet seat to a toilet bowl, the toilet seat hinge comprising:
- a hinge post;
- a pin extending through the hinge post and defining an axis, the pin configured to attach the toilet seat to the hinge post for pivotal movement about the axis; and
- a quick release mechanism for releasably securing the hinge post to the toilet bowl, the quick release mechanism including
  - a mounting post configured to extend from the toilet bowl,
  - a first member coupled to the hinge post, the first member engageable with the mounting post to secure the hinge post to the toilet bowl, and
  - a second member mounted on the pin for pivotal movement relative to the first member and relative to the hinge post about the axis, the second member pivotable about the axis between a first position in which the second member engages the first member so that the hinge post is secured to the toilet bowl, and a second position in which the second member is spaced apart from the first member so that the hinge post is released from the toilet bowl.

2. The toilet seat hinge of claim 1, wherein the second member includes a ring, and wherein the ring surrounds a portion of the pin to pivotally couple the second member to the hinge post.

3. The toilet seat hinge of claim 2, wherein the ring is a first ring, wherein the second member also includes a second ring that is spaced apart from the first ring, and wherein the second ring surrounds a portion of the pin to pivotally couple the second member to the hinge post.

4. The toilet seat hinge of claim 3, wherein the hinge post includes a post portion, wherein the pin extends through the post portion, and wherein the first and second rings are positioned on opposing sides of the post portion.

5. The toilet seat hinge of claim 3, wherein the hinge post includes a post portion having a first leg and a second leg, wherein the pin extends through the first and second legs, and wherein the first and second rings are positioned between the first and second legs.

6. The toilet seat hinge of claim 1, wherein the first member includes a finger, and wherein the finger engages the mounting post when the second member is in the first position to secure the hinge post to the toilet bowl.

7. The toilet seat hinge of claim 6, wherein the finger is coupled to the hinge post, and wherein the finger moves radially inward to engage the mounting post when the second member is in the first position.

8. The toilet seat hinge of claim 7, wherein the finger moves radially outward and disengages the mounting post when the second member is in the second position.

9. The toilet seat hinge of claim 7, wherein the second member includes a wall that engages the finger to move the finger radially inward.

10. The toilet seat hinge of claim 9, wherein the wall defines a recess, and wherein the recess provides clearance for the finger as the second member pivots about the axis from the second position to the first position.

11. The toilet seat hinge of claim 6, wherein the quick release mechanism includes a plurality of fingers that engages the mounting post when the second member is in the first position.

12. The toilet seat hinge of claim 1, further comprising a hinge leaf coupled to the pin for pivotal movement about the axis, wherein the hinge leaf is configured to be attached to the toilet seat.

13. A toilet seat hinge for mounting a toilet seat to a toilet bowl, the toilet seat hinge comprising:
- a hinge post;
- a pin extending through the hinge post and defining an axis, the pin configured to attach the toilet seat to the hinge post for pivotal movement about the axis; and
- a quick release mechanism for releasably securing the hinge post to the toilet bowl, the quick release mechanism including
  - a mounting post configured to extend from the toilet bowl,
  - a finger coupled to the hinge post, the finger engageable with the mounting post to secure the hinge post to the toilet bowl, and
  - a cap member having a ring and a wall, the ring surrounds a portion of the pin to couple the cap member to the hinge post for pivotal movement about the axis, the cap member pivotable about the axis between a first position in which the wall engages the finger to secure the hinge post to the toilet bowl, and a second position in which the wall disengages the finger such that the hinge post is released from the toilet bowl.

14. The toilet seat hinge of claim 13, wherein the ring is a first ring, wherein the cap member also includes a second ring that is spaced apart from the first ring, and wherein the second ring surrounds a portion of the pin to pivotally couple the cap member to the hinge post.

15. The toilet seat hinge of claim 14, wherein the hinge post includes a post portion, wherein the pin extends through the post portion, and wherein the first and second rings are positioned on opposing sides of the post portion.

16. The toilet seat hinge of claim 14, wherein the hinge post includes a post portion having a first leg and a second leg, wherein the pin extends through the first and second legs, and wherein the first and second rings are positioned between the first and second legs.

17. The toilet seat hinge of claim 13, wherein the finger moves radially inward to engage the mounting post when the cap member is in the first position, and wherein the finger moves radially outward and disengages the mounting post when the cap member is in the second position.

18. The toilet seat hinge of claim 17, wherein the wall defines a recess, and wherein the recess provides clearance for the finger as the cap member pivots about the axis from the second position to the first position.

19. The toilet seat hinge of claim 13, wherein the quick release mechanism includes a plurality of fingers coupled to the hinge post, and wherein the plurality of fingers engages the mounting post when the cap member is in the first position.

20. The toilet seat hinge of claim 13, further comprising a hinge leaf coupled to the pin for pivotal movement about the axis, wherein the hinge leaf is configured to be attached to the toilet seat.

21. A toilet seat assembly comprising:
- a toilet seat; and
- a hinge for mounting the toilet seat to a toilet bowl, the hinge including
  - a hinge post;
  - a pin extending through the hinge post and defining an axis, the pin configured to attach the toilet seat to the hinge post for pivotal movement about the axis; and a quick release mechanism for releasably securing the hinge post to the toilet bowl, the quick release mechanism including a mounting post configured to extend from the toilet bowl, a first member coupled to the hinge post, the first member engageable with the mounting post to secure the hinge post to the toilet bowl, and a second member mounted on the pin for pivotal movement relative to the first member and relative to the hinge post about the axis, the second member pivotable about the axis between a first position in which the second member engages the first member so that the hinge post is secured to the toilet bowl, and a second position in which the second member is spaced apart from the first member so that the hinge post is released from the toilet bowl.

* * * * *